US011667012B1

(12) United States Patent
Schmidt et al.

(10) Patent No.: US 11,667,012 B1
(45) Date of Patent: Jun. 6, 2023

(54) SELF-CENTERING DUAL DIRECTION CLAMPING VISE WITH ADJUSTABLE CENTER SUPPORT

(71) Applicant: Kurt Manufacturing Company, Inc., Minneapolis, MN (US)

(72) Inventors: David L. Schmidt, Zimmerman, MN (US); Kelly Staples, Ham Lake, MN (US)

(73) Assignee: KURT MANUFACTURING COMPANY, INC., Minneapolis, MN (US)

( * ) Notice: Subject to any disclaimer, the term of this patent is extended or adjusted under 35 U.S.C. 154(b) by 139 days.

(21) Appl. No.: 16/827,207

(22) Filed: Mar. 23, 2020

Related U.S. Application Data

(60) Provisional application No. 62/821,769, filed on Mar. 21, 2019.

(51) Int. Cl.

| | |
|---|---|
| ***B25B 1/18*** | (2006.01) |
| ***B25B 1/12*** | (2006.01) |
| ***B25B 1/10*** | (2006.01) |
| ***B25B 1/24*** | (2006.01) |

(52) U.S. Cl.
CPC ..... *B25B 1/18* (2013.01); *B25B 1/106* (2013.01); *B25B 1/125* (2013.01); *B25B 1/2405* (2013.01)

(58) Field of Classification Search
CPC ..... B25B 1/103; B25B 1/18; B25B 1/106; B25B 1/125; B25B 1/2405; B25B 1/10
See application file for complete search history.

(56) References Cited

U.S. PATENT DOCUMENTS

| | | | |
|---|---|---|---|
| 983,131 | A | 1/1911 | Gannoe |
| 1,279,011 | A | 9/1918 | Sanford |
| 1,375,236 | A | 4/1921 | Skinder |
| 1,406,981 | A | 2/1922 | Cumner |
| 1,549,278 | A | 8/1925 | Sundstrand |
| 1,753,924 | A | 4/1930 | Gordon |
| 1,811,299 | A | 6/1931 | Brockhaus, Jr. |
| 2,247,656 | A | 7/1941 | Friedrich |
| 2,274,428 | A | 2/1942 | Odin |
| 2,499,124 | A | 2/1950 | Zipp et al. |
| 2,564,138 | A | 8/1951 | Walker |
| 2,570,857 | A | 10/1951 | Purpura |
| 2,744,430 | A | 5/1956 | McLaughlin et al. |
| 2,854,875 | A | 10/1958 | Patrick |
| 3,033,560 | A | 5/1962 | Eklund et al. |

(Continued)

FOREIGN PATENT DOCUMENTS

| | | | |
|---|---|---|---|
| DE | 102006046863 | A1 | 4/2008 |
| EP | 0742081 | A2 | 11/1996 |

(Continued)

OTHER PUBLICATIONS

U.S. Appl. No. 15/701,130, filed Sep. 11, 2017.

*Primary Examiner* — Seahee Hong
(74) *Attorney, Agent, or Firm* — Steven M. Koehler; Westman, Champlin & Koehler, P.A.

(57) ABSTRACT

A vise assembly has a base and a pair of side walls extending from the base and providing guideways. A jaw is configured for guided movement by the guideways. An actuator is coupled to the jaw to cause movement of the jaw. A support supports at least a portion of the actuator. A biasing element is configured to urge the actuator to engage the support.

19 Claims, 11 Drawing Sheets

(56) References Cited

U.S. PATENT DOCUMENTS

| | | | | |
|---|---|---|---|---|
| 3,051,473 | A | 8/1962 | Juhase | |
| 3,342,057 | A | 9/1967 | Stone | |
| 3,397,880 | A | 8/1968 | Kuban | |
| 3,788,635 | A | 1/1974 | Nelson | |
| 3,829,077 | A | 8/1974 | Strybel | |
| 3,834,435 | A | 9/1974 | McCord, Jr. | |
| 4,043,547 | A | 8/1977 | Glomb | |
| 4,098,500 | A | 7/1978 | Lenz | |
| 4,192,521 | A | 3/1980 | Smith | |
| 4,251,066 | A | 2/1981 | Bowling | |
| 4,291,870 | A | 9/1981 | Warde | |
| 4,383,682 | A | 5/1983 | Feinberg | |
| 4,413,818 | A | 11/1983 | Lenz | |
| 4,429,887 | A | 2/1984 | Smith | |
| 4,529,183 | A | 7/1985 | Krason et al. | |
| 4,583,724 | A | 4/1986 | Huang | |
| 4,684,115 | A | 8/1987 | Krause | |
| 4,685,663 | A | 8/1987 | Jorgensen | |
| 4,898,371 | A | 2/1990 | Mills et al. | |
| 4,928,937 | A | 5/1990 | Bernstein | |
| 4,934,674 | A | 6/1990 | Bernstein | |
| 4,958,818 | A | 9/1990 | Buchter | |
| 5,022,636 | A | 6/1991 | Swann | |
| 5,065,990 | A | 11/1991 | Durfee | |
| 5,098,073 | A | 3/1992 | Lenz | |
| 5,121,908 | A | 6/1992 | Shatkus et al. | |
| 5,141,213 | A | 8/1992 | Chern | |
| 5,163,662 | A | 11/1992 | Bernstein | |
| 5,242,159 | A | 9/1993 | Bernstein | |
| 5,442,844 | A | 8/1995 | Swann | |
| 5,458,321 | A | 10/1995 | Durfee, Jr. | |
| 5,497,982 | A | 3/1996 | Stoltz et al. | |
| 5,505,437 | A | 4/1996 | Durfee, Jr. | |
| 5,649,694 | A | 7/1997 | Buck | |
| 5,683,077 | A | 11/1997 | Fink | |
| 5,698,867 | A | 12/1997 | Bauer | |
| 5,720,476 | A | 2/1998 | Swann et al. | |
| 5,806,841 | A | 9/1998 | Hebener | |
| 5,860,197 | A * | 1/1999 | Fox | B25B 1/103 24/522 |
| 6,012,712 | A | 1/2000 | Bernstein | |
| 6,017,026 | A | 1/2000 | Durfee, Jr. | |
| 6,032,940 | A | 3/2000 | Wolfe | |
| 6,053,490 | A | 4/2000 | Berchtold | |
| 6,062,553 | A | 5/2000 | Strehl | |
| 6,079,704 | A | 6/2000 | Buck | |
| 6,139,001 | A | 10/2000 | Buck | |
| 6,164,635 | A | 12/2000 | Chase et al. | |
| 6,170,814 | B1 | 1/2001 | Swann et al. | |
| 6,244,580 | B1 | 6/2001 | Durfee, Jr. | |
| 6,250,620 | B1 | 6/2001 | Durfee, Jr. | |
| 6,409,161 | B1 | 6/2002 | Wolff et al. | |
| 6,773,003 | B2 | 8/2004 | Dermody, Jr. | |
| 6,957,809 | B1 | 10/2005 | Ferrara | |
| 7,134,650 | B2 | 11/2006 | Trudel et al. | |
| 7,163,201 | B2 | 1/2007 | Bernstein | |
| 8,020,877 | B2 | 9/2011 | Lang | |
| 8,152,175 | B1 | 4/2012 | Maro et al. | |
| 8,158,242 | B2 | 4/2012 | Nishihata et al. | |
| 8,322,699 | B2 | 12/2012 | Prell | |
| 9,004,472 | B2 | 4/2015 | Schmidt | |
| 9,095,958 | B2 | 8/2015 | Schmidt | |
| 9,364,937 | B2 | 6/2016 | Taylor et al. | |
| 10,179,392 | B2 * | 1/2019 | Taylor | B25B 1/2478 |
| 10,384,331 | B2 * | 8/2019 | Maggert | B25B 1/103 |
| 2006/0049566 | A1 | 3/2006 | Bernstein | |
| 2008/0203637 | A1 | 8/2008 | Li et al. | |
| 2010/0164158 | A1 | 7/2010 | Weissenborn | |
| 2010/0164159 | A1 | 7/2010 | Wurthele | |
| 2010/0219573 | A1 | 9/2010 | O'Rell et al. | |
| 2012/0068393 | A1 | 3/2012 | Van De Vosse et al. | |
| 2014/0131933 | A1 * | 5/2014 | Taylor | B25B 1/24 269/265 |
| 2016/0023329 | A1 * | 1/2016 | Schlussel | B25B 1/2489 269/242 |
| 2017/0001284 | A1 * | 1/2017 | Maggert | B25B 1/103 |
| 2018/0272499 | A1 * | 9/2018 | Cheng | B25B 1/2489 |
| 2020/0238478 | A1 * | 7/2020 | Bronzino | B25B 5/102 |

FOREIGN PATENT DOCUMENTS

| | | | |
|---|---|---|---|
| EP | 1607183 | A2 | 12/2005 |
| GB | 171435 | A | 11/1921 |
| JP | 2008264983 | A | 11/2008 |

* cited by examiner

SELF-CENTERING DUAL DIRECTION CLAMPING VISE WITH ADJUSTABLE CENTER SUPPORT

CROSS-REFERENCE TO RELATED APPLICATION

The present application is based on and claims the benefit of U.S. provisional patent application Ser. No. 62/821,769, filed Mar. 21, 2019, the content of which is hereby incorporated by reference in its entirety.

BACKGROUND

The discussion below is merely provided for general background information and is not intended to be used as an aid in determining the scope of the claimed subject matter. The present disclosure relates to vises, and in one aspect to a self-centering vise that has two movable jaws mounted on a base. An actuator such as a screw moves the jaws together or separates them depending on the direction of screw rotation to hold the workpiece.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter.

In a first aspect a vise assembly has a base and a pair of side walls extending from the base and providing guideways. A jaw is configured for guided movement by the guideways. An actuator is coupled to the jaw to cause movement of the jaw. A support supports at least a portion of the actuator. A biasing element is configured to urge the actuator to engage the support.

In a second aspect a vise assembly has a base and a pair of side walls extending from the base and providing guideways. A first jaw and a second jaw are configured for guided movement by the guideways. An actuator is coupled to the first jaw and the second jaw to cause selective movement of the first jaw and the second jaw toward and away from each other. A support is adjustable and securable to the base between the first jaw and the second jaw. The support is configured to support at least a portion of the actuator. A retainer is configured to engage the actuator. A biasing element is configured to engage the retainer and urge the retainer against the actuator and the actuator to engage the support.

DESCRIPTION OF THE ILLUSTRATIVE EMBODIMENT

Figure 1:
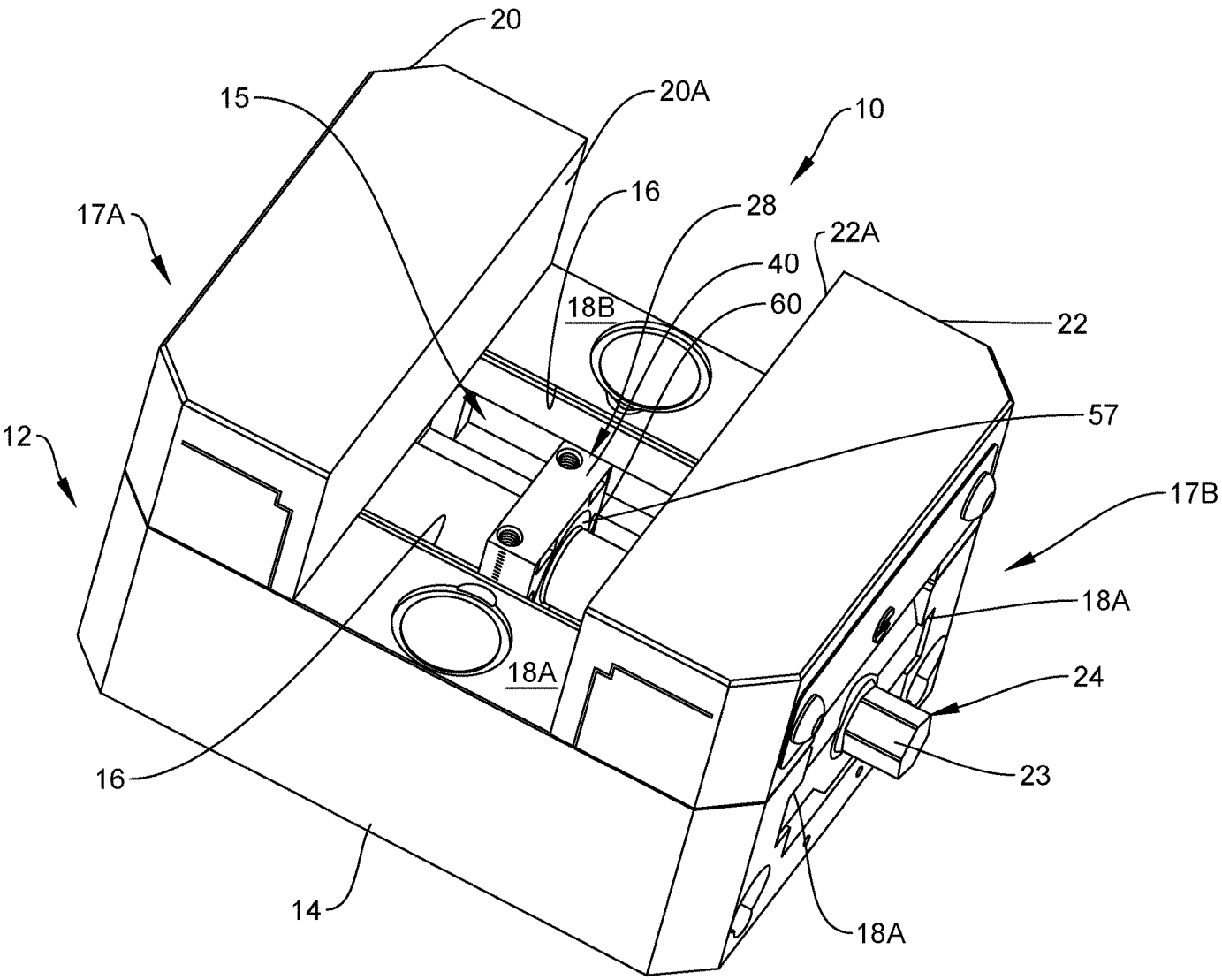
FIG. 1 is a perspective view of a vise.
Figure 2:
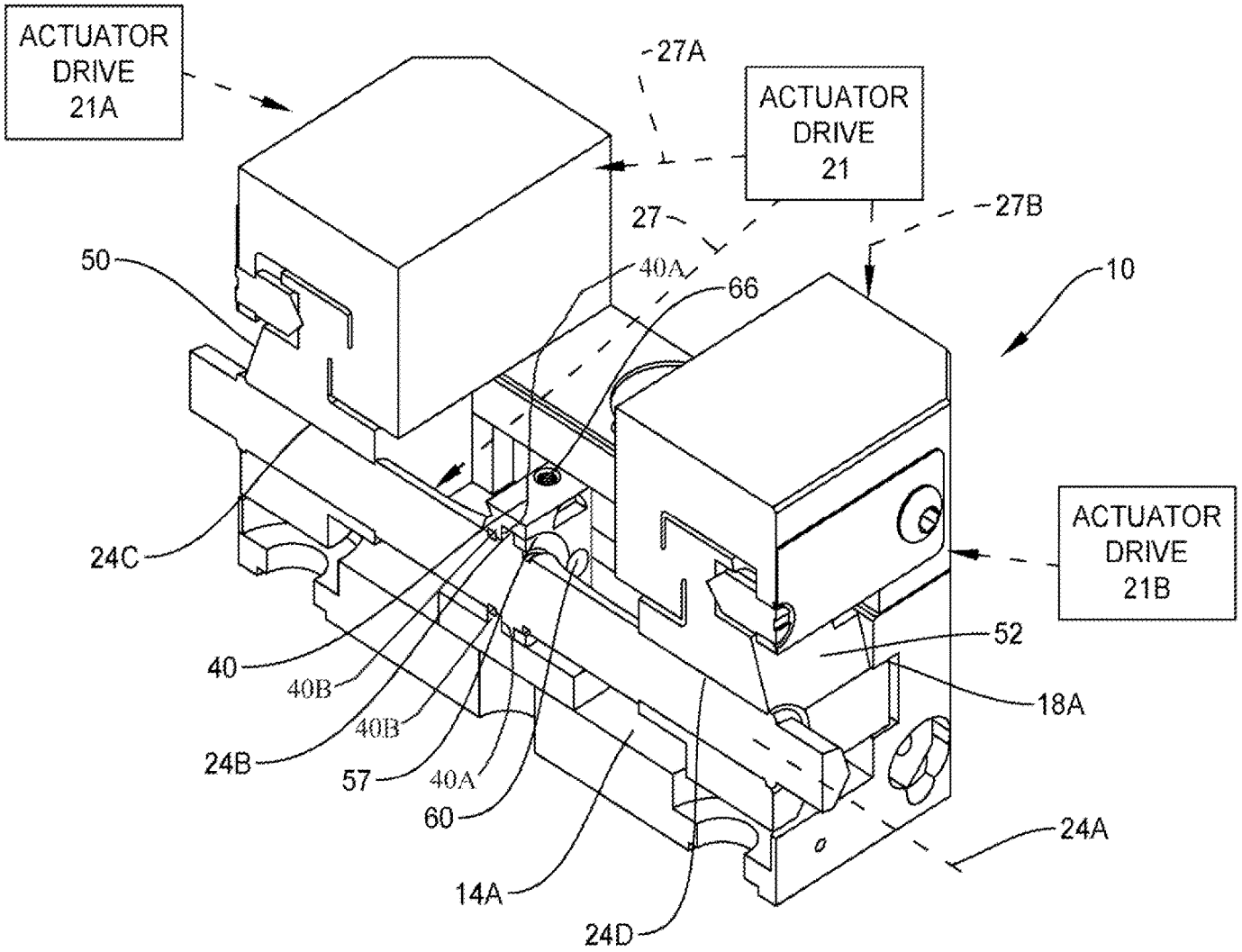
FIG. 2 is a sectional view of the vise of FIG. 1.
Figure 3:
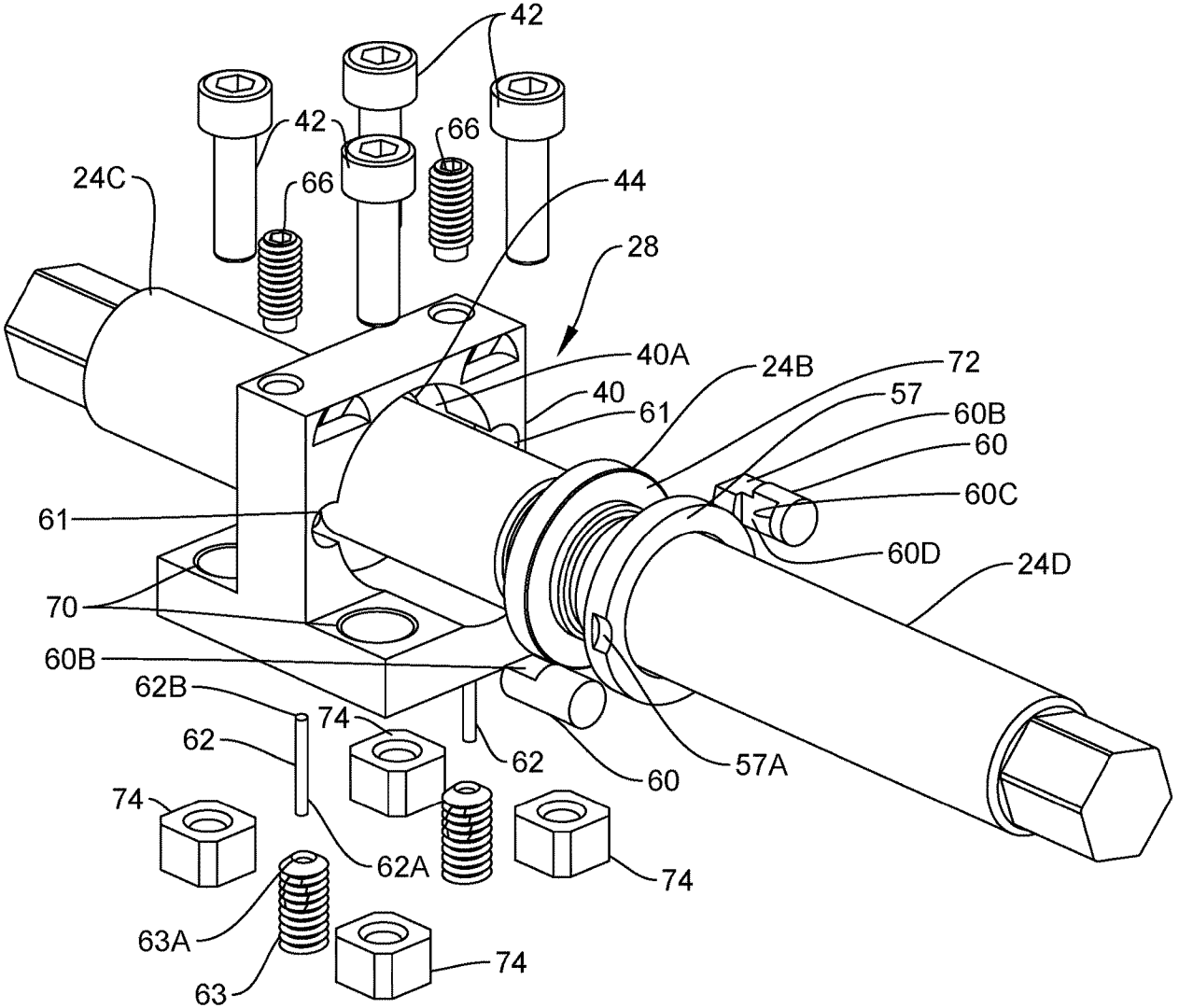
FIG. 3 is a partial exploded view of a vise screw and center support.
Figure 4:
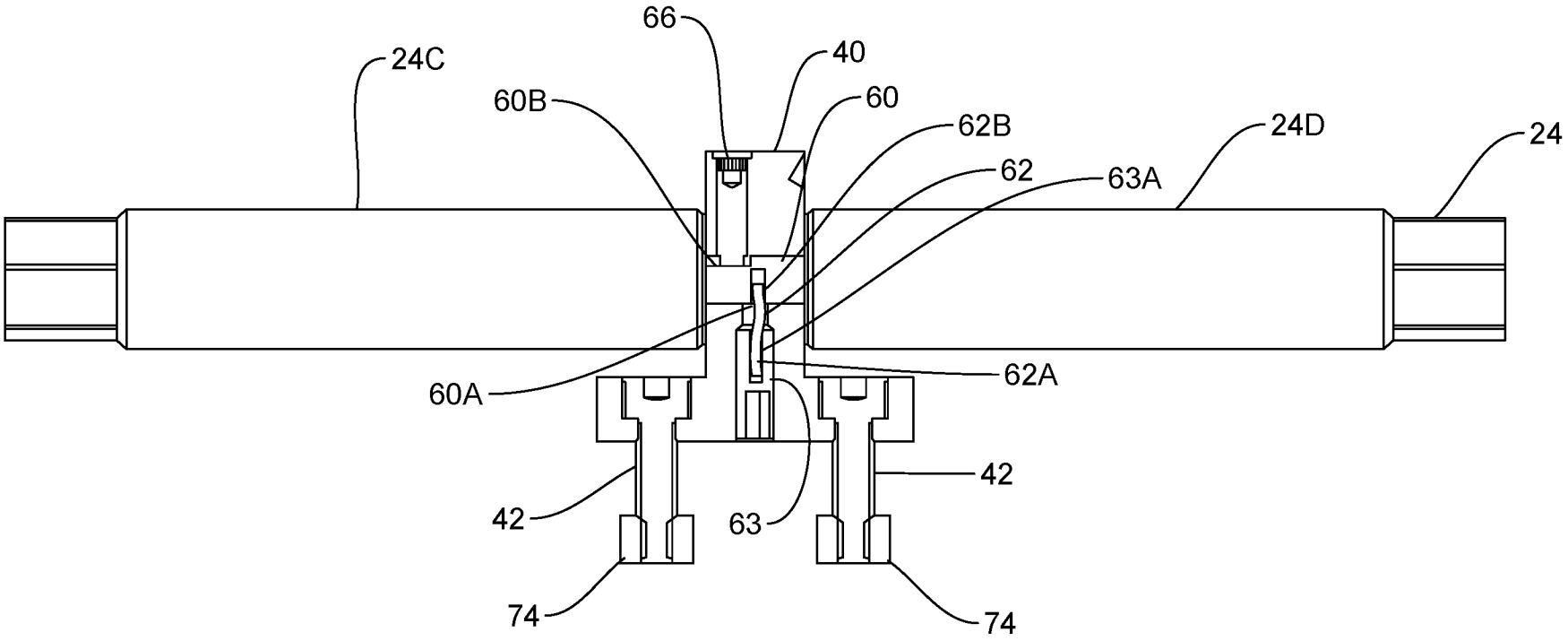
FIG. 4 is a sectional view through the center support and a side elevational view of the vise screw.
Figure 5:
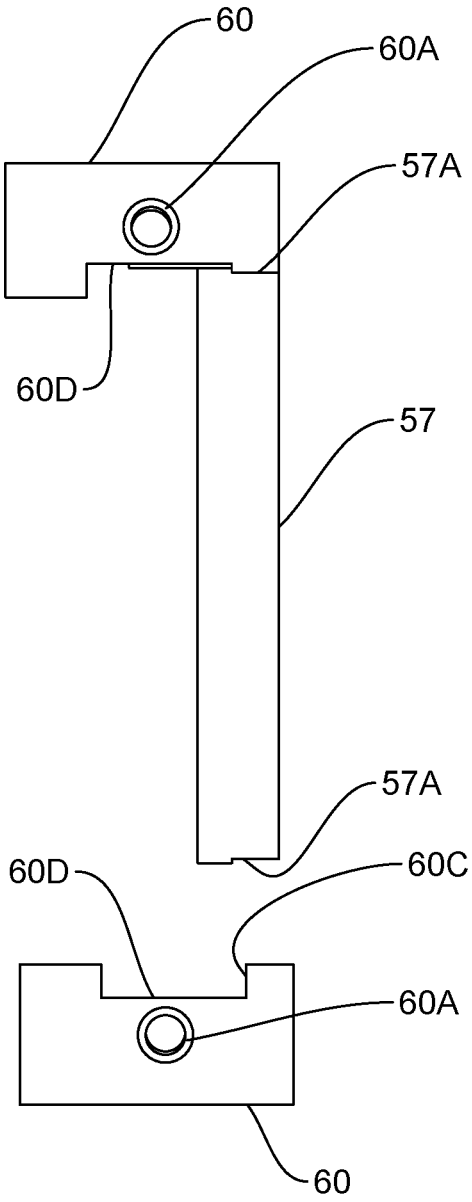
FIG. 5 is a top plan view of a retainer ring and locking pins.
Figure 6:
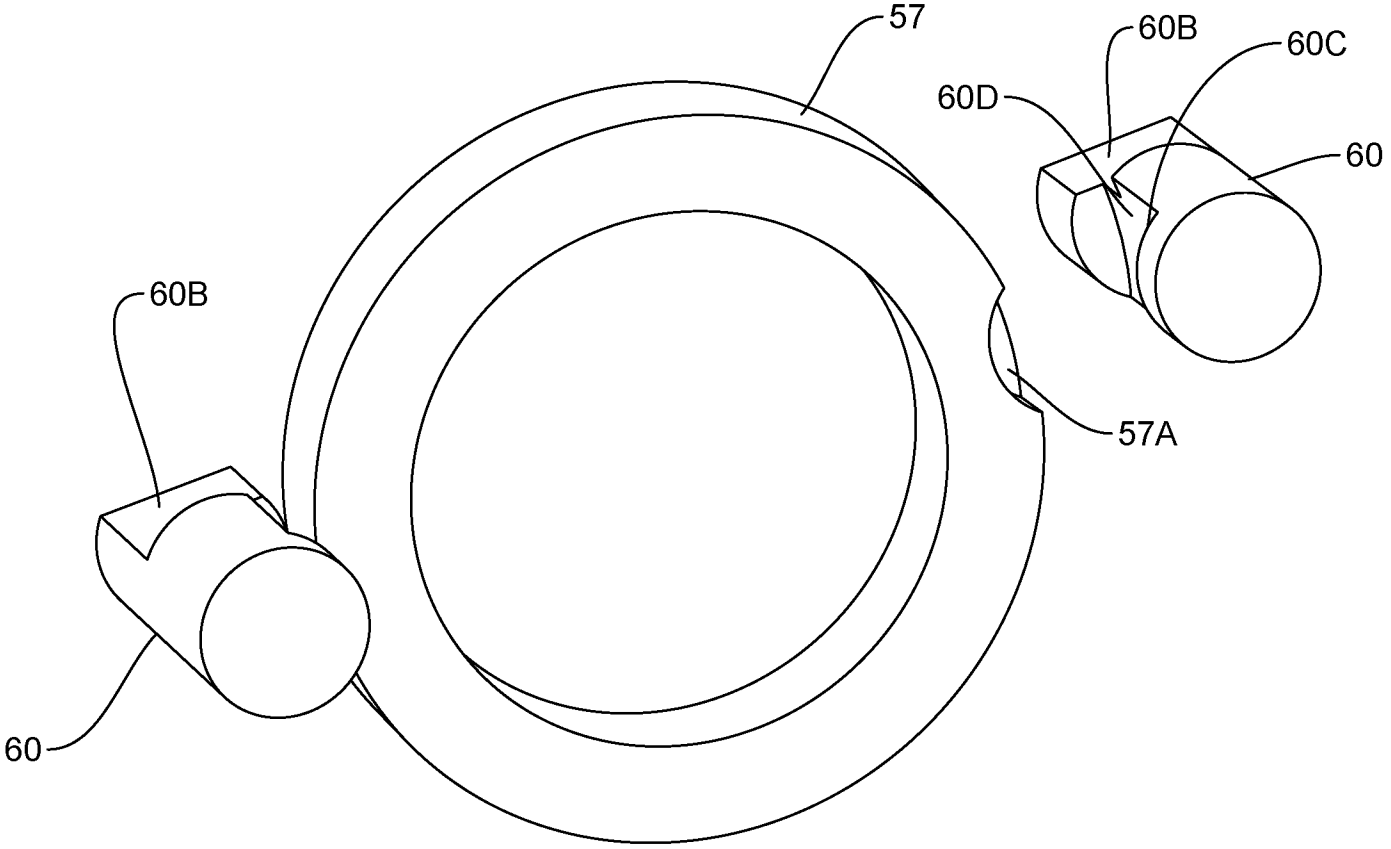
FIG. 6 is a perspective view of the retainer ring and the locking pins.

A self-centering vise assembly indicated at 10 in FIGS. 1 and 2 includes a vise body 12. Vise body 12 has a base 14 and a pair of spaced apart side rails 16 that extend away from the base 14 and have surfaces indicated at 18A and 18B that form guideway surfaces for slidably supporting and/or guiding a first movable jaw 20 and a second movable jaw 22. The jaw 20 has clamping surface 20A, while the second jaw 22 has clamping surface 22A. In the exemplary embodiment illustrated, the clamping surfaces 20A and 22A face each other, although it should be understood that if desired, jaws 20 and 22 can be of the type that has clamping surfaces facing away from each other. The clamping surfaces 20A, 22A are shown as being parallel and perpendicular to the plane of the surfaces 18A or 18B, but the clamping surfaces 20A, 22A could be carved or sculpted as necessary for the workpiece to be clamped.

At least a portion of a jaw drive actuator 24 is positioned in a recess 15 formed between the side rails 16 and base 14, and is supported on a center support 28. The center support 28 is adjustably secured to the base 14 such as on surface 14A, preferably along a linear path that is parallel to an axis 24A of the actuator portion 24. Since the center support 28 supports the actuator portion 24 that in turn supports the jaws 20, 22, connected thereto, adjusting the position of the center support 28 along the path also moves the actuator portion 24 and the connected jaws 20 and 22 as a unit. In this manner, the base 14 can be fixedly secured in a stationary position to a support surface, not shown, but the pair of jaws 20 and 22, actuator portion 24 and center support 28 can be moved as a unit so as to position the jaws 20 and 22 so as to clamp the workpiece as desired.

The actuator used to move the jaws 20, 22 can take many forms. For instance, the actuator can comprise a screw drive where actuator portion 24 comprises a vise screw that can be rotated with a drive such as by a handle (not shown) couplable to an end 23. In another embodiment, a drive schematically illustrated at 21 in FIG. 2 can comprise a motor (e.g. electric, pneumatic or hydraulic) coupled for example with gears to rotate the actuator portion 24 as represented by arrow 27. In another embodiment, the actuator portion 24 does not rotate but rather allows the jaws 20, 22 to slide thereon. The drive 21 can be linear actuator (e.g. electric, pneumatic or hydraulic) with a mechanical linkage to displace the jaws 20, 22 simultaneously toward and away from the center support 28 represented by arrows 27A, 27B. In yet another embodiment, the drive can comprise separate drive actuators 21A, 21B for each jaw 20, 22, respectively, that are controlled to displace the jaws 20, 22 preferably simultaneously. For purposes only of discussion, the actuator portion 24 will be referred to as a vise screw 24 although this should not be considered limiting.

In this embodiment, guideways include lower surfaces 18A upon which the jaws 20, 22 are guided and/or upper surfaces 18B. In other words, for a given jaw separation between the clamping surfaces 20A and 22A, the center support 28 can be moved in a direction toward end 17A along the axis 24A as well as in a direction toward end 17B along the axis 24A. Commonly though the amount of movement needed of the jaws 20 and 22, vise screw 24 and center support 28 is small since the vise 10 has been secured to a support surface in a position close to what is needed. For instance, the jaws 20 and 22 can be aligned relative to a device to perform work upon the workpiece, for example, but not limited to a cutting tool such as supported by a spindle chuck. When the jaws 20 and 22 are properly positioned (i.e. centered or otherwise aligned with the cutting tool), the clamping surfaces 20A, 22A will contact surfaces of the workpiece at the same time when being clamped so as to not inadvertently cause a shift in the workpiece, which would contribute to inaccuracies in the finished workpiece.

Referring also to FIGS. 3-6, the center support 28 includes a base member 40 with one or more securing devices 42 that move with the base member 40 and will selectively engage the base 14 to hold the base member 40 in a fixed position when desired. In the exemplary embodiment, the base member 40 supports the vise screw 24 for rotation and includes an aperture 44 through which the vise screw 24 extends in part therethrough. The vise screw 24 includes a collar 24B. The collar 24B can be formed from the material of the vise screw 24 thereby providing an integral assembly formed from a single unitary body. In an alternative embodiment, the collar 24B can be secured to the vise screw 24 in any suitable manner, such as being welded thereto, or secured with fasteners such as set screw(s). While a first portion 24C of the vise screw 24 can extend through the aperture 44, the collar 24B will engage an annular surface 40A of a single annular flange 40B of the base member 40, thereby limiting further insertion of the vise screw 24 through the aperture 44.

The vise screw 24 is secured to the base member 40 in a fixed axial position, allowing the vise screw 24 to rotate about axis 24A when needed to cause desired movement of the jaws 20, and 22. Typically, the vise screw 24 includes outwardly facing threads on each of portions 24C and 24D that engage threaded bores in a jaw nut 50 and 52 of each jaw 20 and 22, respectively.

In the embodiment illustrated, a retainer herein embodied as a ring 57 secures the vise screw 24 in the base member 40. After portion 24C of the vise screw 24 has been inserted through aperture 44 such that the collar 24B engages the annular surface 40A provided on the base member 40, the retaining ring 57 is moved along portion 24D of the vise screw 24 to engage an annular flange 72 on the collar 24B. Locking pins 60 are configured to be secured to the base member 40 and to engage retaining ring 57, thus securing the retaining ring 57 relative to the base member 40 and holding the vise screw 24 in the base member 40, but allowing rotation when desired. Each of the locking pins 60 are disposed in cylindrical, in part, shaped recesses 61 such as bores through the base member 40. Biasing devices 62 urge the locking pins 60 in a direction into the base member 40. As stated above, each of the locking pins 60 engage the retaining ring 57, thus the biasing devices 62 urge the retaining ring 57 against the annular flange 72, while the annular flange 72 urges the collar 24B against annular 40A thereby reducing any backlash of the vise screw 24 relative to the base member 40. The biasing members 62 comprise springs that preferably bias the screw 24 in a direction parallel to the movement of the jaws. In the embodiment illustrated, the springs 62 bias the locking pins 60 parallel to the axis 24A. In this embodiment, the springs 62 operate or urge in bending and comprise spring rods or wire having a first end 62A secured to the base member 40 in a stationary position herein with the use of a support element such as a set screw 63 that receives the first end 62A in a recess 63A. A second end 62B of each spring 62 engages the locking pin 60 by being inserted in recesses 60A. In this embodiment, the springs 62 are oriented so as to be orthogonal to the axis 24A. Preferably, the recesses 60A are not located above the recesses 63A such that the spring rod or wire is bent and/or stretched having bending or tension stresses present therein that creates a spring force by the spring rod wanting to return to its original shape prior to being stressed. The spring force of the springs 62 urges the respective locking pins 60 into the base member 40.

Securing fasteners 66 are provided to engage and secure the locking pins 60 when the vise screw 24 has been properly seated in the base member 40. In the embodiment illustrated, the securing fasteners 66 comprise set screws. Preferably each locking pin 60 includes a flat surface 60B that is oriented to face the fastener 66 by the spring rod or wire 62 being inserted in the recess 60A.

The locking pins 60 can be configured so as to engage the retaining ring 57 securely. In the embodiment illustrated, each locking pin 60 includes a flange 60C formed on an end of the locking pin 60. Complementary recesses 57A can be provided to form flanges that engage the flanges 60C. It should be noted that each locking pin 60 can also include inwardly facing (toward axis 24A) notches 60D configured to receive the retaining ring 57 and the collar 24B.

Figure 7:
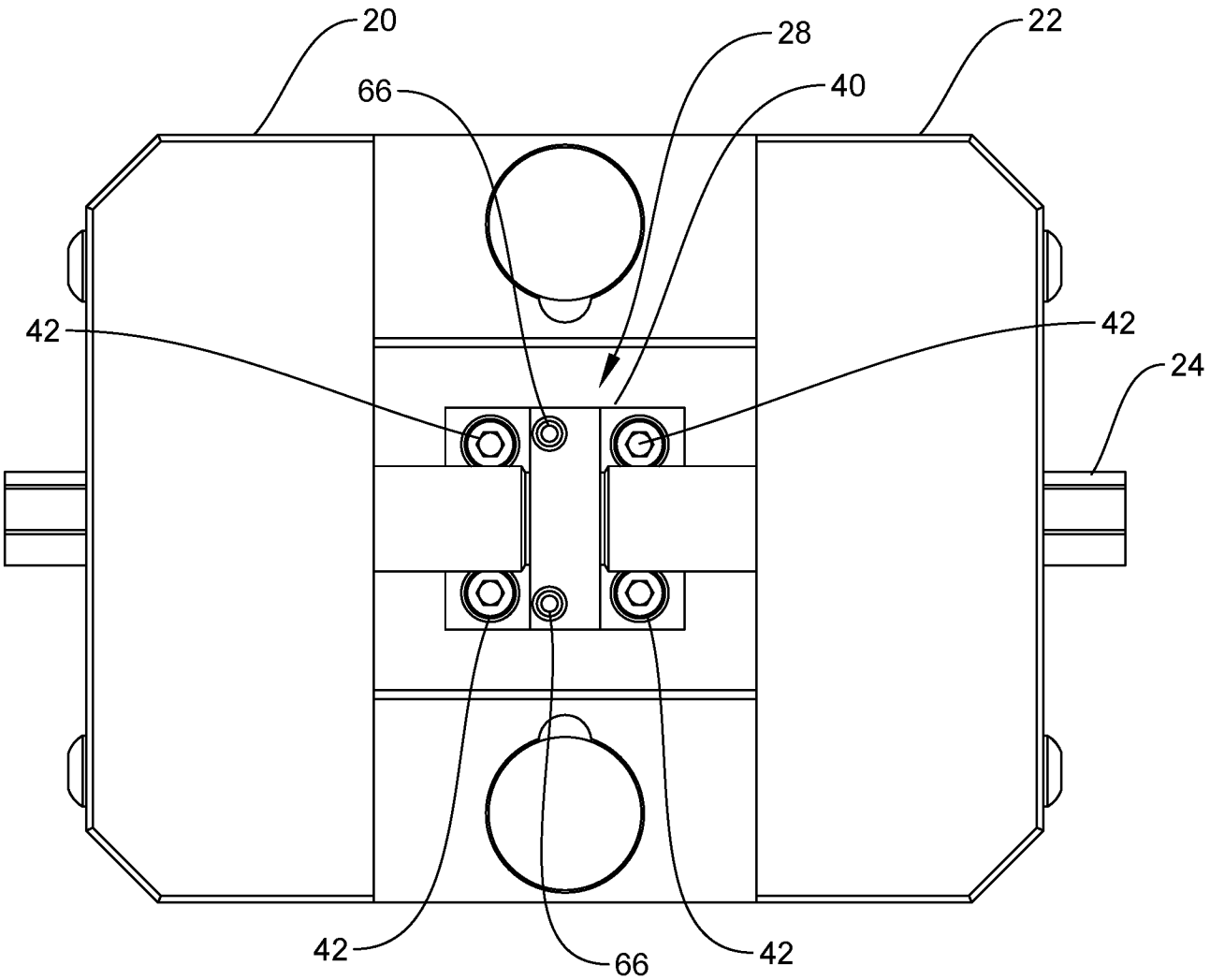
FIG. 7 is a top plan view of the vise of FIG. 1.
Figure 8:
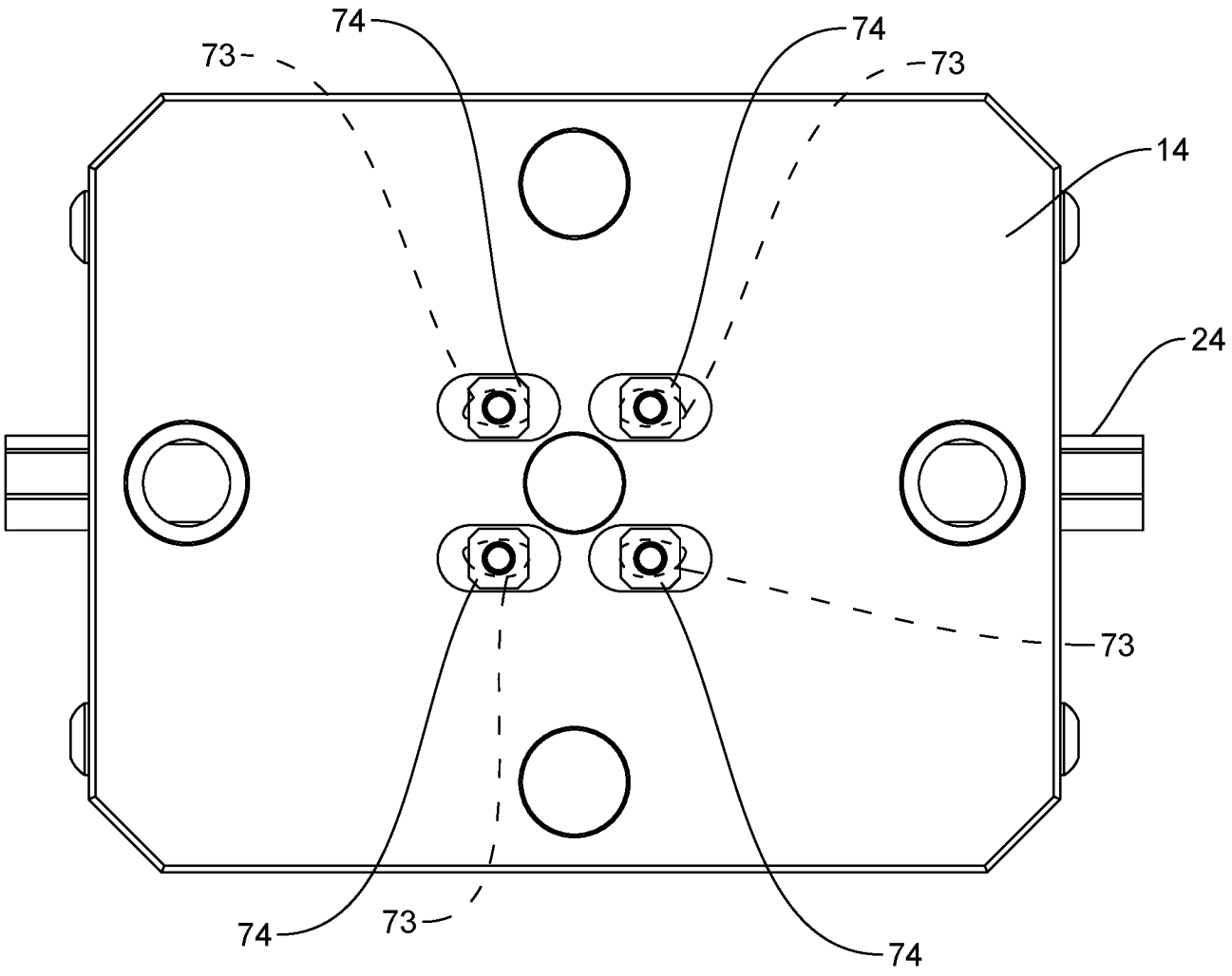
FIG. 8 is a bottom plan view of the vise of FIG. 1.

As indicated above, the securing devices 42 are used to secure the center support 28, fixing its position on the base 14 when desired. Each securing device 42 preferably comprises a fastener herein comprising a bolt extending through an aperture 70 provided in the base member 40. Referring to FIGS. 7 and 8, the end of the bolt 42 extends through an oblong aperture 73 in the base 14. A nut 74 is secured to the end of each bolt 42. The oblong nature of the apertures 73 allows the position of the base member 40 to be adjusted upon the base 14.

Figure 9:
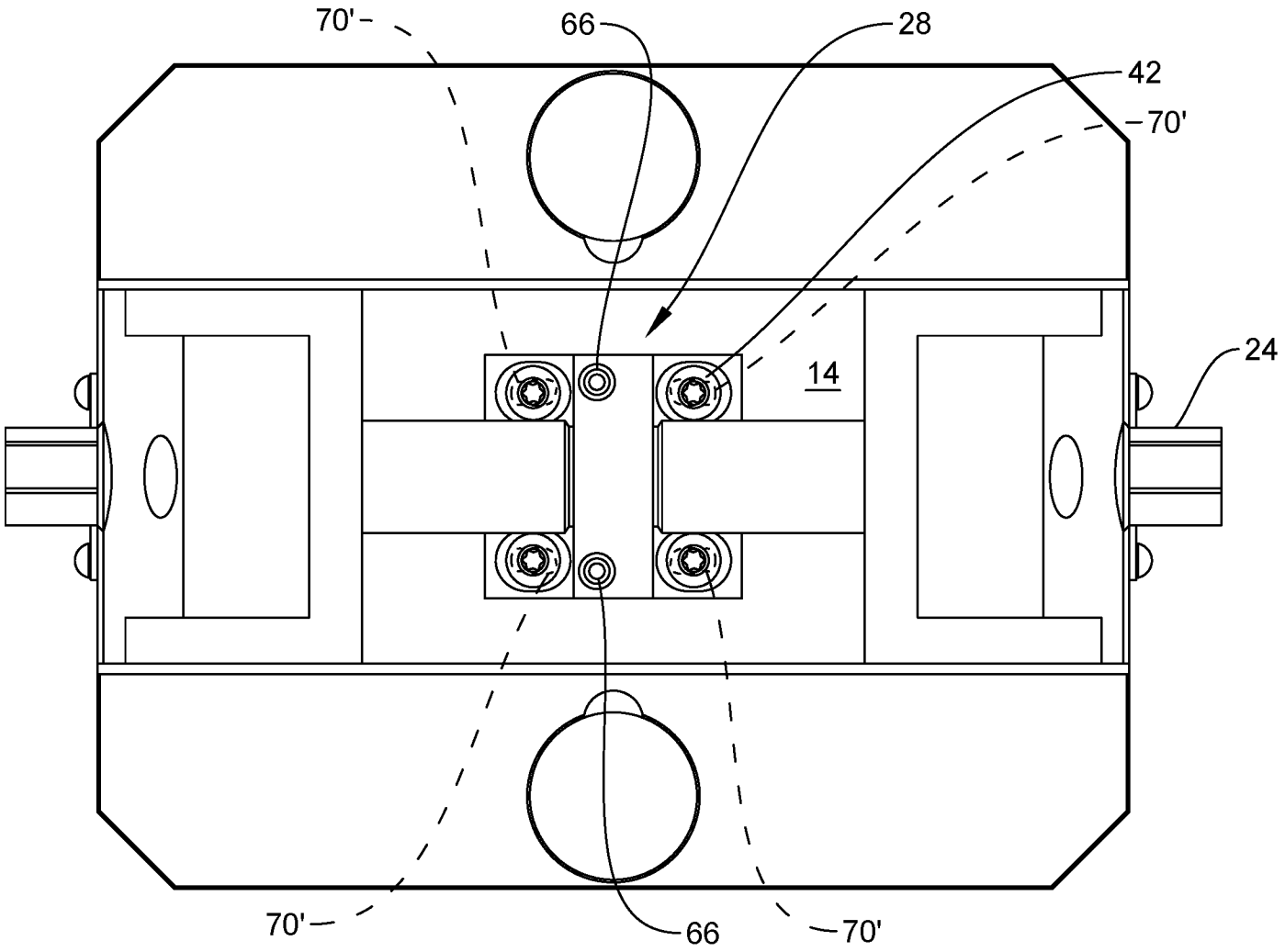
FIG. 9 is a top plan view of a vise with another center support.

FIG. 9 illustrates an alternative configuration for allowing the base member 40 to be selectively positioned on the base 14. In this embodiment, the apertures 70' in the base member 40 are oblong. The bolts 42 can be threadably received in apertures provided in the base 14.

Figure 10:
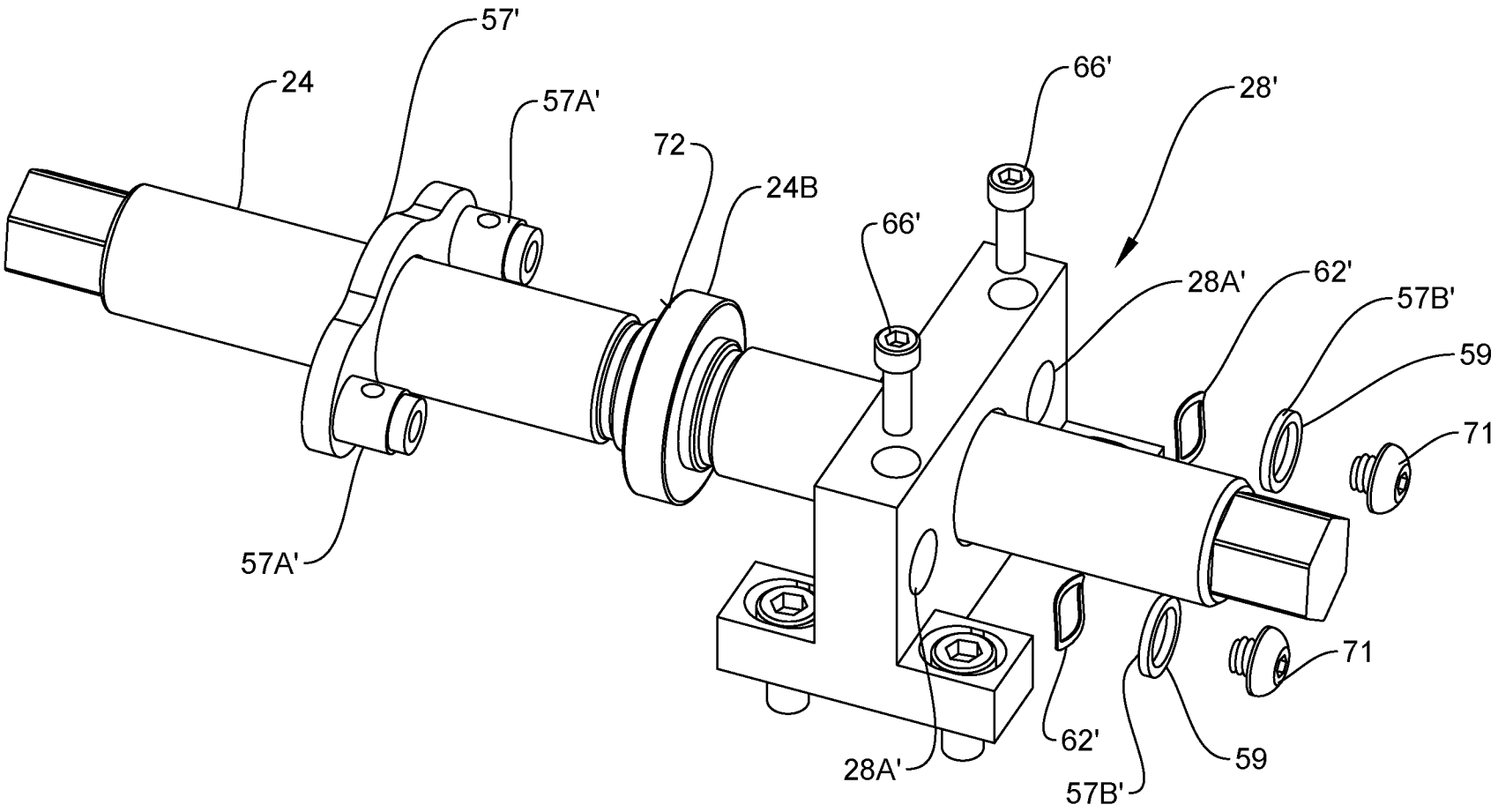
FIG. 10 is a partial exploded view of a vise screw and yet another center support.
Figure 11:
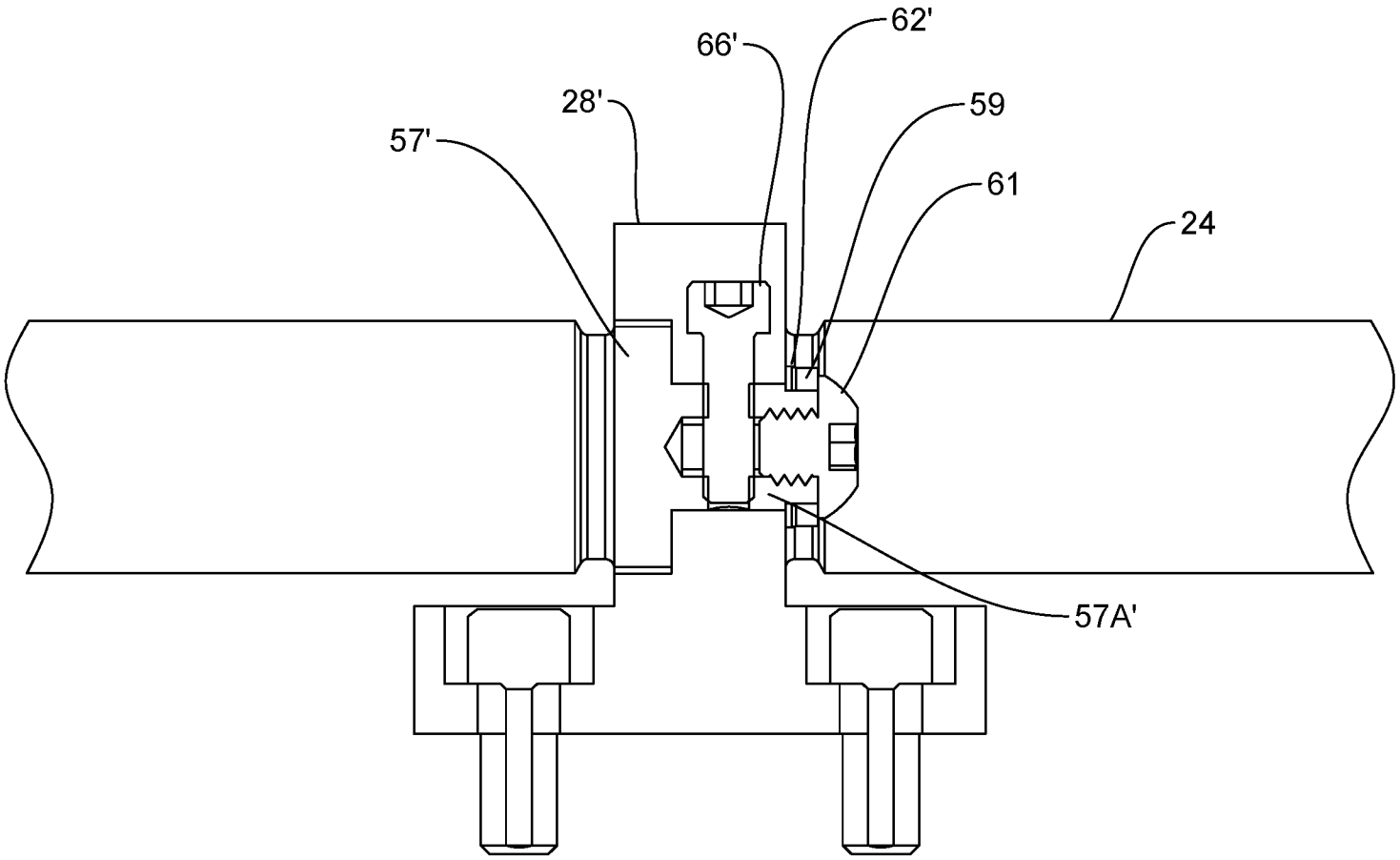
FIG. 11 is a sectional view through the center support and a partial side elevational view of the vise screw of FIG. 10.

In the embodiment described above, the biasing element 62 comprise springs that operate in bending. However, this should not be considered limiting. For example, other embodiments can include biasing elements that operate in tension or compression to urge the screw 24 against the support 28. FIGS. 10 and 11 illustrate such an embodiment of the screw 24 held in a support 28' where it should be noted the same or similar reference numbers have been used to identify elements that are the same or similar to the embodiment described above. Generally, a retainer in the form of a ring 57' engages the annular flange 72 of the collar 24B, where biasing elements 62' urge the retainer 57' into the support 28'. In this embodiment, the retainer 57' includes portions 57A' that extend into and can slide in bores 28A' of support 28'. On a side of support 28' opposite retainer 57', the biasing elements 62' are disposed. The biasing elements 62' comprise springs in this embodiment in the form of Bellevue washers compressed and located between a side of the support 28' and a flange 57B' created on the portions 57A'. The flange 57B' is created by a washer 59 secured to the free end of each portion 57A' by a fastener 71. A set screw 66' mates with each portion 57A' and secures or locks the position of the retainer 57' in the support 28'.

In each of the embodiments, the retainers 57, 57' engage the screw 24 urging the screw 24 into the supports 28, 28' where the movement provided allows the screw 24 to be reseated in the supports 28, 28, when desired. In particular, repeated use of the vise assemblies causes wear between collar 24B and the retainers 57, 57' and the supports 28, 28', which allows the screw 24 to axially move relative to the support 28, 28'. In order to reseat the screw 24 in the supports 28, 28', the locks or fixing devices, herein set screws 66, 66' are operated so as to release the retainers 57, 57' on the supports 28, 28'. With the retainers 57, 57' released, the biasing elements 62, 62' urge the retainers 57, 57' against the collar 24B, and the collar 24B against the support 28, 28', thus displacing the screw 24 relative to the support 28, 28'. At this point, the locks or fixing devices 66, 66' are operated so as to again secure the retainers 57, 57' to the support 28, 28'. Although the amount of movement of the screw 24 and retainers 57, 57' is typically very small in high precision workpiece handling, the errors caused by the relative loose movement of screw 24 to the support 28, 28' can be significant.

It should be noted that aspects of the present invention are suitable for a single acting vise rather than vise 10 having two opposed jaw nuts 50, 52. In a single acting vise, the actuator 24 includes a single jaw nut such as jaw nut 52. The retainers 57, 57' can still act upon the actuator 24 such as upon collar 24B due to springs 62, 62' and where locks of fixing devices 66, 66' are operated so as to again secure the retainers 57, 57' to the support 28, 28'. As explained above, this structure can be used to reduce backlash due to wear of the contacting surfaces between the actuator 24 and retainers 57, 57' and/or supports 28, 28'.

Although the subject matter has been described in language directed to specific environments, structural features and/or methodological acts, it is to be understood that the subject matter defined in the appended claims is not limited to the environments, specific features or acts described above as has been held by the courts. Rather, the environments, specific features and acts described above are disclosed as example forms of implementing the claims.

What is claimed is:

1. A vise assembly comprising:

a base;

a pair of side walls extending from the base having guideways;

a first jaw and a second jaw, each jaw configured for guided movement by the guideways;

an actuator having a longitudinal axis and coupled to the first jaw and the second jaw to cause selective movement of the first jaw and the second jaw toward and away from each other, the actuator having a fixed annular collar;

a support secured to the base between the first jaw and the second jaw, the support having a single annular flange configured to engage the annular collar on one side;

a retainer configured to move axially with respect to the longitudinal axis and engage the annular collar on a side opposite the single annular flange of the support; and a spring having a first end joined to the retainer and a second end joined to base or the support, the spring configured to urge the retainer axially toward the single annular flange of the support.

2. The vise assembly of claim 1, further comprising a lock configured to secure the retainer to the support.

3. The vise assembly of claim 2 wherein the actuator rotates relative to the support and the retainer.

4. The vise assembly of claim 3, further comprising a pair of spaced apart locking pins coupled to the retainer and slidable in bores in the support, the lock comprising a fastener for each locking pin to secure a position of the locking pin in the bore.

5. The vise assembly of claim 4 wherein the spring comprises a first spring coupled to a first pin of the pair of spaced apart locking pins and a second spring coupled to a second pin of the pair of spaced apart locking pins.

6. The vise assembly of claim 5 wherein the retainer comprises a ring encircling the actuator.

7. The vise assembly of claim 5 wherein each of the first spring and the second spring comprise a compression spring.

8. The vise assembly of claim 4, wherein the retainer and each of the spaced apart locking pins are movable relative to each other.

9. The vise assembly of claim 1 wherein the support is adjustably secured to the base.

10. The vise assembly of claim 1 wherein the support is slidable upon the base over a selected distance and fixable to the base.

11. The vise assembly of claim 1 wherein the spring comprises a compression spring.

12. The vise assembly of claim 1 wherein the spring is configured to create a spring force due to bending.

13. The vise assembly of claim 1 further comprising a fastener to secure the retainer to the support.

14. The vise assembly of claim 1 wherein the retainer comprises a ring encircling the actuator.

15. The vise assembly of claim 14 further comprising a pair of spaced apart elements coupled to the retainer and slidable in bores in the support and a fastener for each element to secure a position of the element in the bore.

16. The vise assembly of claim 15 wherein the spring comprises a first spring coupled to a first element of the pair of spaced apart elements and a second spring coupled to a second element of the pair of spaced apart elements.

17. The vise assembly of claim 16 wherein the each of the first spring and the second spring comprise a compression spring.

18. The vise assembly of claim 17 wherein an end fastener is secured to each element, where each spring urges each associated end fastener away from the support.

19. The vise assembly of claim 18 wherein the retainer and each of the spaced apart elements are movable relative to each other.

* * * * *